US009314829B2

(12) United States Patent
Kunze et al.

(10) Patent No.: US 9,314,829 B2
(45) Date of Patent: Apr. 19, 2016

(54) PANEL BENDING MACHINE WITH SWIVELING BLADE

(71) Applicant: SALVAGNINI ITALIA S.p.A., Sarego (Vicenza) (IT)

(72) Inventors: Wolfgang Kunze, Leonding (AT); Johann Klingesberger, Ottensheim (AT)

(73) Assignee: SALVAGNINI ITALIA S.P.A., Sarego (Vicenza) (IT)

( * ) Notice: Subject to any disclaimer, the term of this patent is extended or adjusted under 35 U.S.C. 154(b) by 277 days.

(21) Appl. No.: 14/033,685

(22) Filed: Sep. 23, 2013

(65) Prior Publication Data

US 2014/0090442 A1 Apr. 3, 2014

(30) Foreign Application Priority Data

Sep. 24, 2012 (IT) ..... MI2012A1583

(51) Int. Cl.
*B21D 5/04* (2006.01)

(52) U.S. Cl.
CPC . *B21D 5/04* (2013.01); *B21D 5/045* (2013.01)

(58) Field of Classification Search
CPC ..... B21D 5/04; B21D 5/045
USPC ..... 72/306, 319, 452.1, 323
See application file for complete search history.

(56) References Cited

U.S. PATENT DOCUMENTS 4,356,716 A * 11/1982 Aschauer ..... B21D 5/045 72/306
4,843,862 A * 7/1989 Salvagnini ..... B21D 5/045 72/319
6,470,727 B1 * 10/2002 Kunze ..... B21D 5/04 72/319
8,006,531 B2 * 8/2011 Patuzzi ..... B21D 5/04 72/306
8,312,752 B2 * 11/2012 Patuzzi ..... B21D 5/04 72/306
2007/0266752 A1 11/2007 Patuzzi et al.

FOREIGN PATENT DOCUMENTS

EP 0 022 122 A1 1/1981
EP 1 819 457 B1 2/2009
EP 2 127 771 A1 12/2009

OTHER PUBLICATIONS

Italian Search Report and Written Opinion issued Jun. 24, 2013 in corresponding Italian Application No. IT MI20121583.

* cited by examiner

*Primary Examiner* — David B Jones
(74) *Attorney, Agent, or Firm* — Wenderoth, Lind & Ponack, L.L.P.

(57) ABSTRACT

A panel bending machine (1) has a counter-blade (3) and a blank holder (5) shaped so as to clamp a sheet metal panel (4) to be bent. The panel bending machine (1) further comprises a "C" type blade holder (7), the terminals of which can be coupled to at least a first (9) and a second (11) bending blade. The machine (1) further has an actuating mechanism (100) of the blade holder structured to swivel the second blade (11) in two different working positions (P2, P3).

20 Claims, 10 Drawing Sheets

PANEL BENDING MACHINE WITH SWIVELING BLADE

BACKGROUND OF THE INVENTION

The present invention relates to a panel bending machine with swiveling blade.

Panel bending machines, also known as paneling machines, used to bend sheet metal panels to a required profile, are known.

The sheet panel inserted in the paneling machine is locked between two members, a lower one named counter-blade, used to support the sheet panel, and a mobile upper member, named blank holder. The blank holder may be actuated vertically between a first upper position, which allows the introduction of the sheet panel in the machine between the blank holder and the counter-blade, and a second lower position for locking the panel and allowing the machining thereof. Paneling machines are equally known which also include the horizontal movement of the blank holder with respect to the counter-blade to allow further bending combinations.

During the step of bending, the panel is positioned so that one end thereof, the one intended to be bent, protrudes horizontally towards the inside of the machine. The panel end is bent either upwards or downwards by means of bending blades fitted on an essentially "C"-shaped support, named blade holder, which is actuated by hydraulic pistons or cam-connecting rod systems. Such a blade presses on the protruding end of the sheet to bend it by levering on the counter-blade and the blank holder.

The current solutions display limits in the case of particular bending profiles, characterized, for instance, by a small counter-bend interposed between two much wider bends. Indeed, the known paneling machines may not be able to carry out the described bending sequence for reasons of mechanical interference between panel and bending blades.

In view of the prior art, it is the object of the present invention to provide a panel bending machine with swiveling blade which can overcome this constraint.

In accordance with the present invention, said object is reached by means of a panel bending machine as disclosed in claim 1.

BRIEF DESCRIPTION OF THE DRAWINGS

The features and the advantages of the present invention will be apparent from the following detailed description of practical embodiments thereof, shown by way of non-limitative example in the accompanying drawings, in which.

DETAILED DESCRIPTION OF THE PREFERRED EMBODIMENTS

Figure 1:
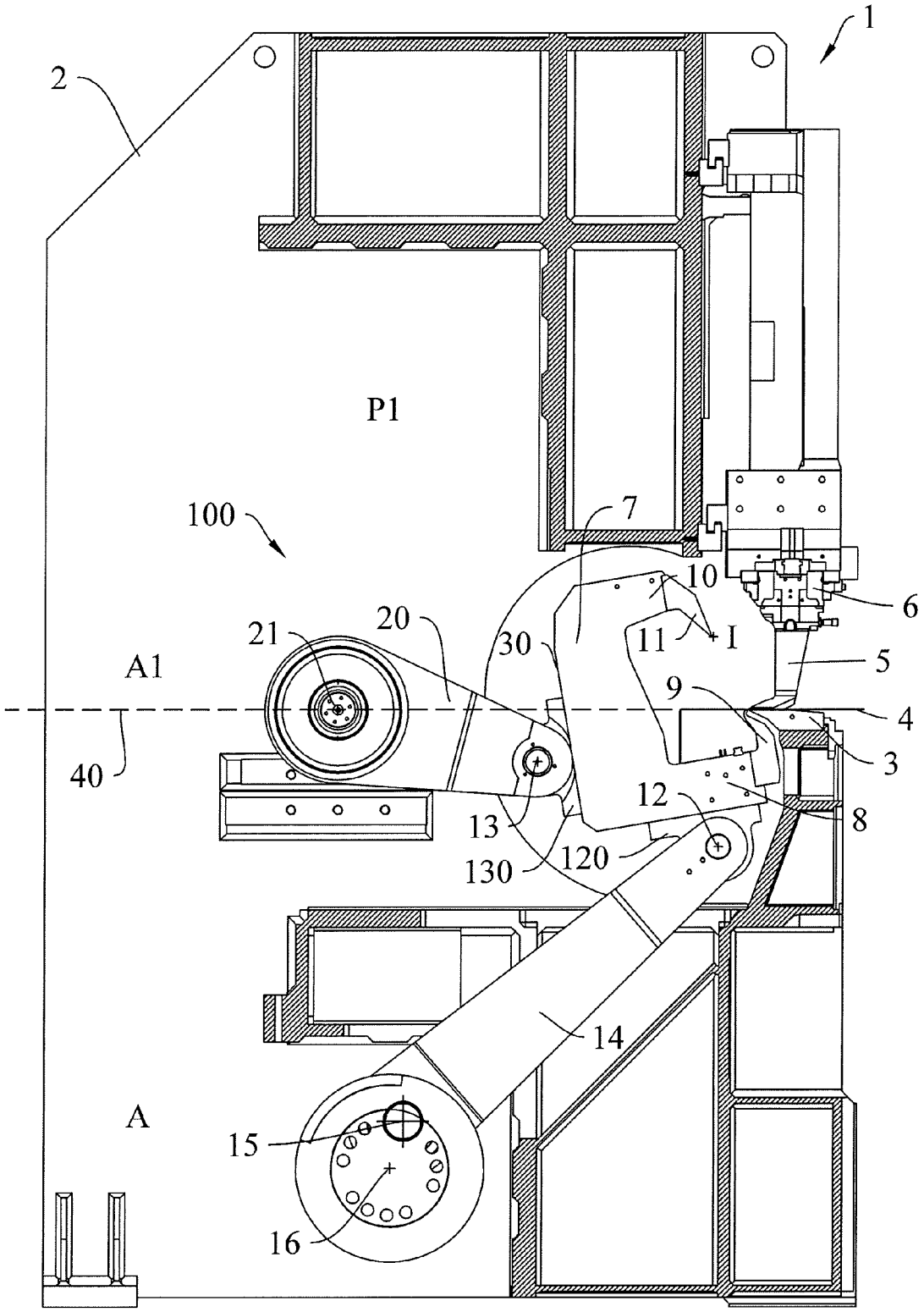
FIG. 1 is a side view of a panel bending machine with swiveling blade according to a first embodiment of the present invention.

FIG. 1 shows a first embodiment of a paneling machine 1 comprising a frame 2 and a counter-blade 3 integral to the frame 2 which supports a sheet panel 4 to be bent. A blank holder 5 is arranged above the counter-blade 3 and fixed to means 6 for vertically actuating the blank holder 5, the means 6 being adapted to press the blank holder 5 against the counter-blade 3 to clamp the panel 4. The blank holder 5 may also include a horizontal type adjustment with respect to the counter-blade 3 to allow making further bend combinations of the sheet panel 4.

The paneling machine 1 comprises an essentially "C"-shaped (or "C" type) blade holder 7 with two terminals 8 and 10 and a connection portion 30 of the terminals 8, 10. A first bending blade, or lower blade, 9, adapted to bend the sheet panel 4 upwards, is connected to a first terminal, or lower terminal, 8 of the blade holder, while a second bending blade, or upper blade, 11, adapted to bend downwards, is normally coupled to the second terminal, or upper terminal, 10 of the blade holder 7.

Actuating means 100 (or actuating system) of the blade holder 7 configured to rotate and translate the blade holder 7 are provided.

The actuating means 100 of the blade holder 7 include a first member 14, 15, 16, 12, 120 hinged to a terminal of the blade holder 7, preferably to the lower terminal 8 of the blade holder 7 by means of a pin 12, and a second member 20, 21, 13, 130 hinged to the connection portion 30 of the blade holder by means of a pin 13.

The blade holder 7 comprises extensions 120 of the terminal 8 and 130 on the part of the connection 30 for engaging the respective pins 12, 13; connecting rods 14, 20 are engaged on one end to the pins 12, 13, and the other end to the frame 2 of the paneling machine. In particular, the connecting rod 14 is rotationally connected to a cam comprising a pin 15 arranged in the peripheral part of a motorized disc 16; the latter is preferably arranged in the lower part A of the frame 2 of the paneling machine, preferably in the frame portion 2 beneath the counter-blade 3. The connecting rod 20 is rotationally connected to a pin 21 connected to the frame 2, preferably in the central part A1 of the frame 2, and preferably so that the continuation line 40 of the work top, which corresponds to the sheet metal panel 4 when the panel 4 is clamped on the counter-blade 3 by the blank holder 5, substantially passes through the pin 21. The pin 21 is motorized in the case of the embodiment shown in FIG. 1. The rotation axes of the blade holder, of the pins 21, 13, 12 and of the disc 16 are orthogonal to the direction of movement of the blade holder 7 and are preferably aligned with the bending direction of the panel 4.

The rotation of the cam 15, 16 allows the rotation of the blade holder 7, while the combination of the rotation of the cam 15, 16 and of the rotation of the motorized pin 21 allows translations of the blade holder 7 itself either upwards/downwards, or rightwards/leftwards.

According to a second embodiment (FIGS. 2-4), the actuating means 100 of the paneling machine 1 comprise a further member 130, 13, 17, 18, 19 hinged to the connection portion 30 of the blade holder by means of the pin 13. The further member comprises a connecting rod 17 which engages the pin 13 on one end and is rotationally connected to a cam on the other end, which comprises a pin 18 arranged on the edge of a motorized disc 19. The latter is preferably arranged in the upper part A2 of the frame 2 of the paneling machine, and preferably in the portion of frame 2 above the counter-blade 3. A further member allows a better distribution of the actuating action to be exerted on the blade holder 7. The pin 21 is idle in this case, i.e. not motorized, and only has movement restraint functions. The rotation axes of the pin 18 and of the disc 19 are orthogonal to the direction of movement of the blade holder 7, and preferably aligned with the bending direction of the panel 4.

Figure 2:
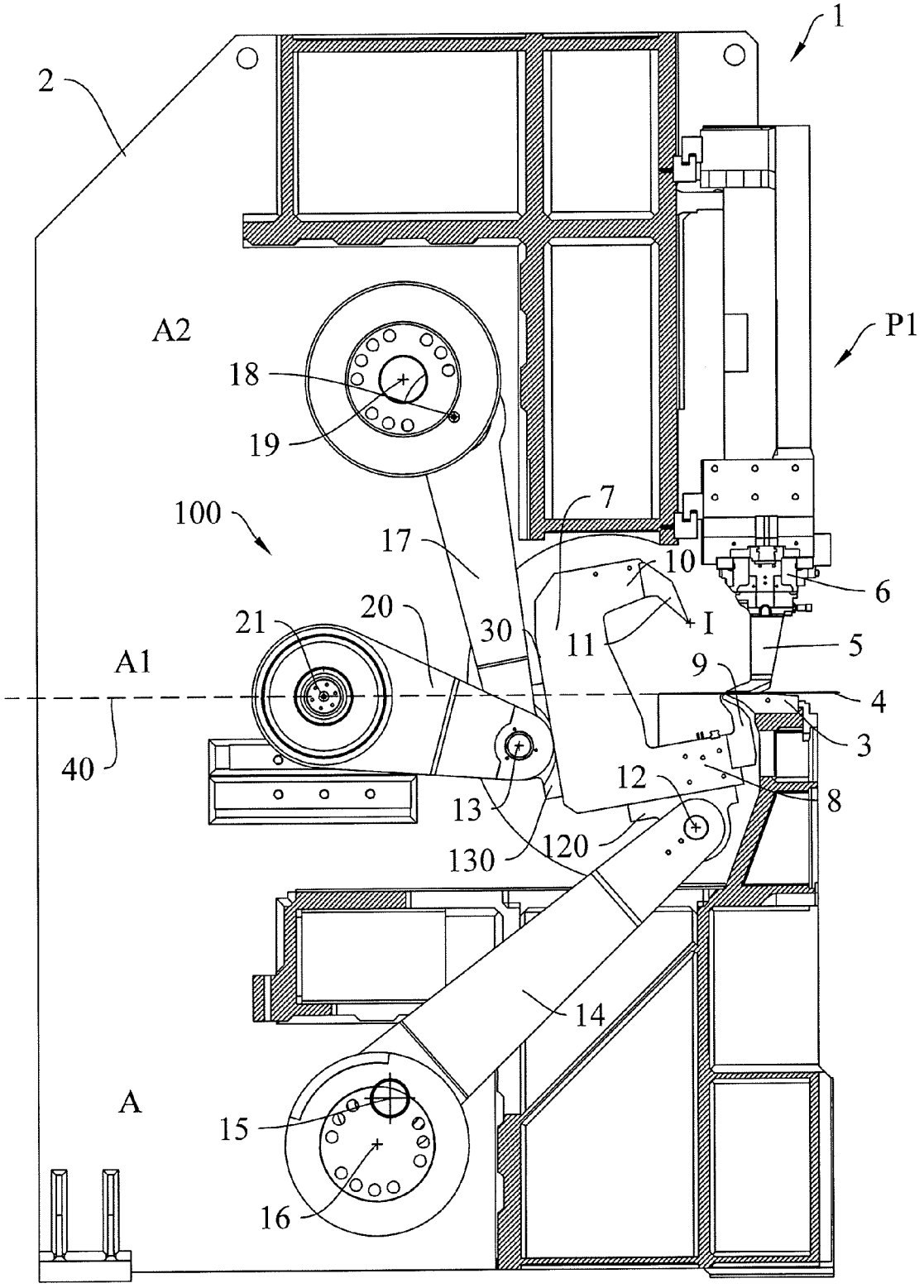
FIG. 2 is a side view of a panel bending machine with swiveling blade according to a second embodiment of the present invention with blade holder in a first working position.
Figure 3:
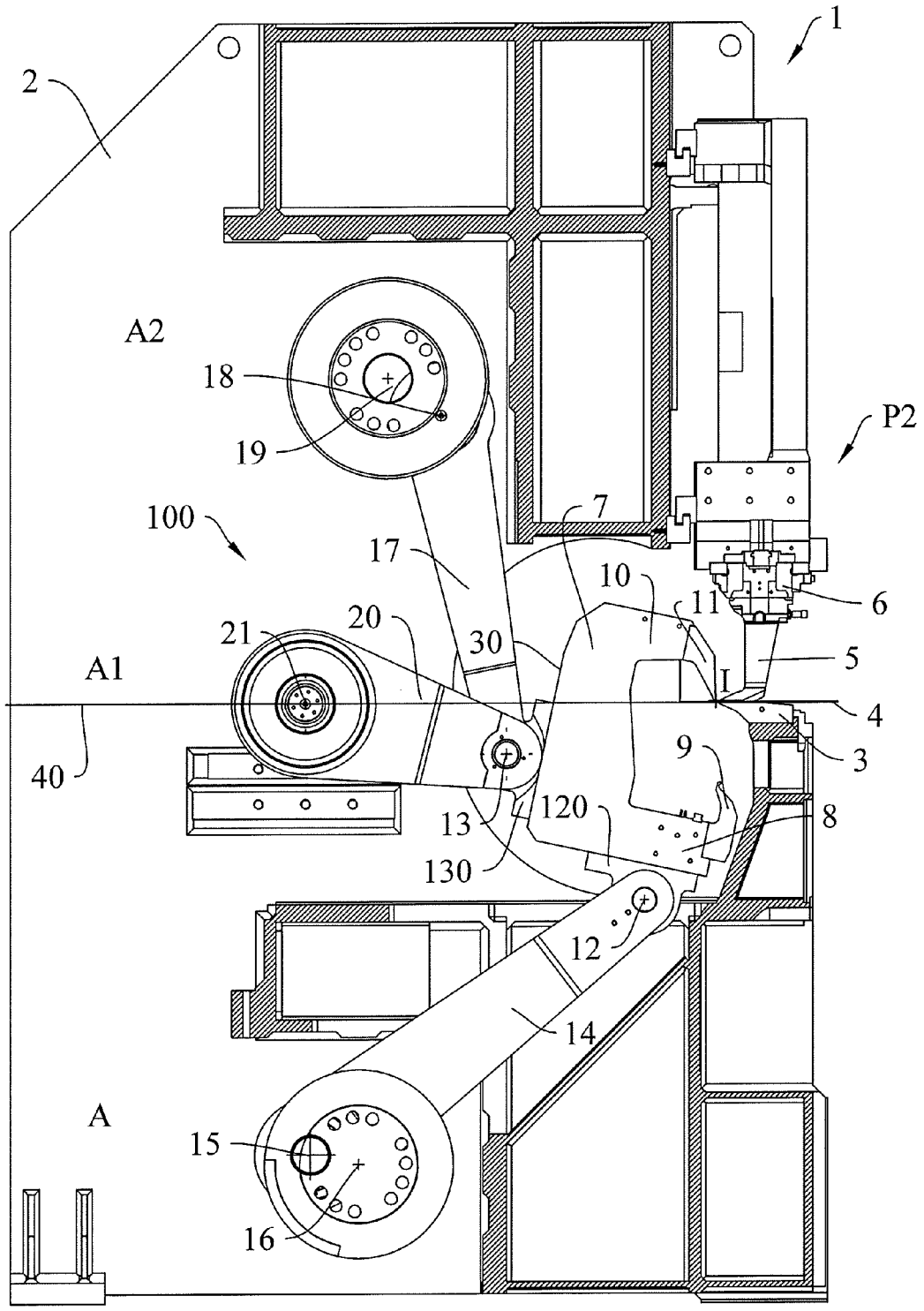
FIG. 3 shows the paneling machine according to a second embodiment of the present invention with blade holder in a second working position.
Figure 4:
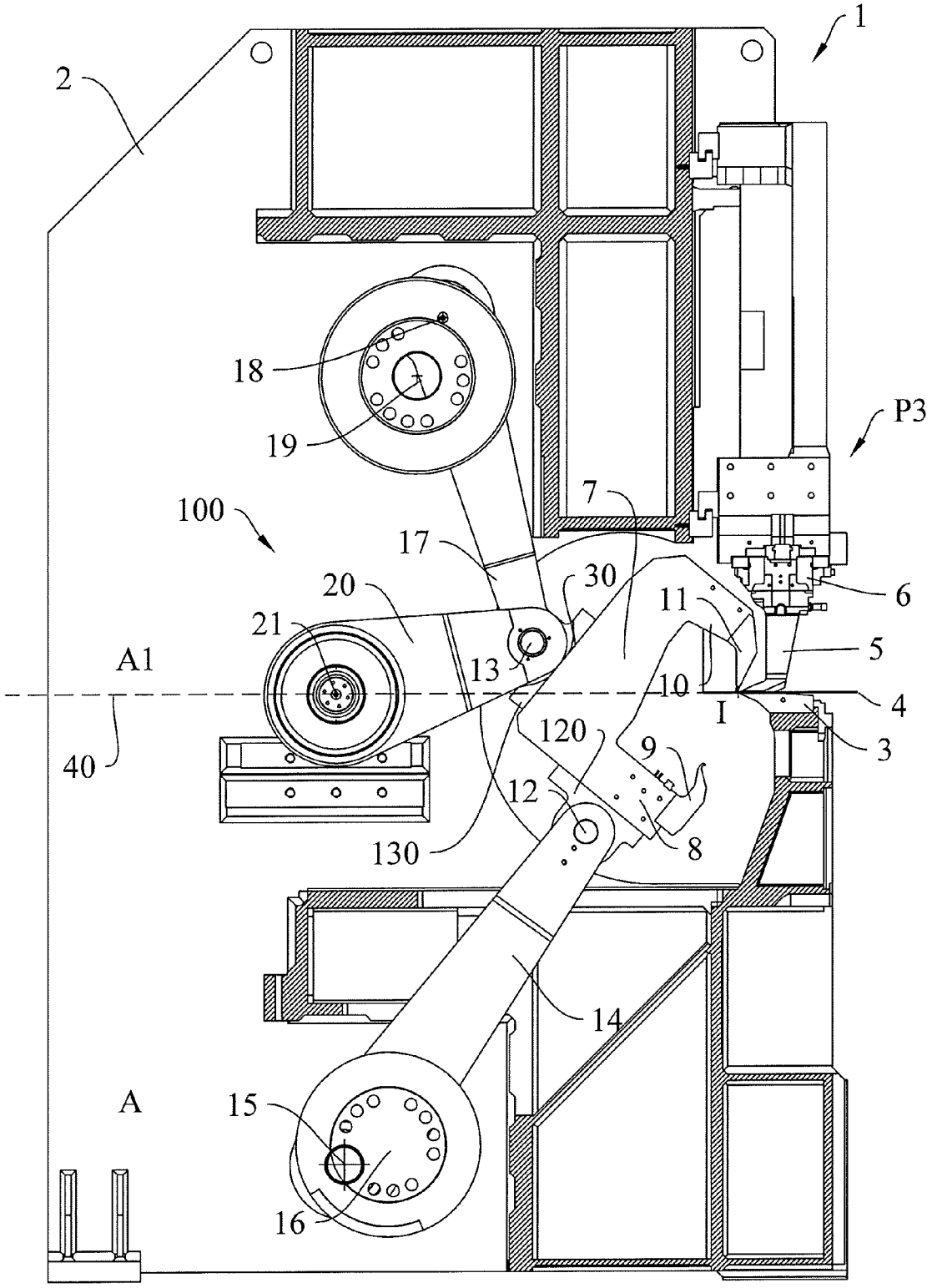
FIG. 4 shows the paneling machine according to a second embodiment of the present invention with blade holder in a third working position.

In both embodiments, the actuating means 100 of the paneling machine are structured to implement configurations or working positions P1-P3 of FIGS. 2-4, i.e. the positions in which the bending blade 9 or 11 is about to bend the sheet panel 4 with the sheet panel 4 itself locked between blank holder 5 and counter-blade 3, preferably arranged horizontally. In particular, the actuating means 100 are structured to swivel the blade 11 in a working position P2 and in another working position P3 different from working position P2.

In both embodiments of the paneling machine 1, the blade 11 preferably has a different shape from the known blades; in particular, the blade 11 is wedge-shaped and the end of the wedge coincides with the free end 111 of the blade. The angle Q of the wedge, i.e. the angle between the inner surface 140 (i.e. the surface which faces the connection portion 30 of the blade holder 7) and the outer surface 141 (i.e. the surface which faces the blank holder 5), is preferably comprised between 25° and 35°.

The combination of the rotation or roto-translation motion of the blade holder 7 caused by the actuating means 100 and the particular shape of the blade 11 with inner surface 140 and outer surface 141 allows the blade 11 to be swiveled with the inner surface profile 140 or with the outer surface profile 141 substantially perpendicular to the plane identified by the panel 4 in working positions P3 and P2, as shown in FIGS. 3 and 4.

In working configuration P1 (FIG. 2), the blade holder 7 is rotated by the actuating means 100 to allow the lower blade 9 to bend the sheet panel 4 upwards in working position P1.

Figure 9:
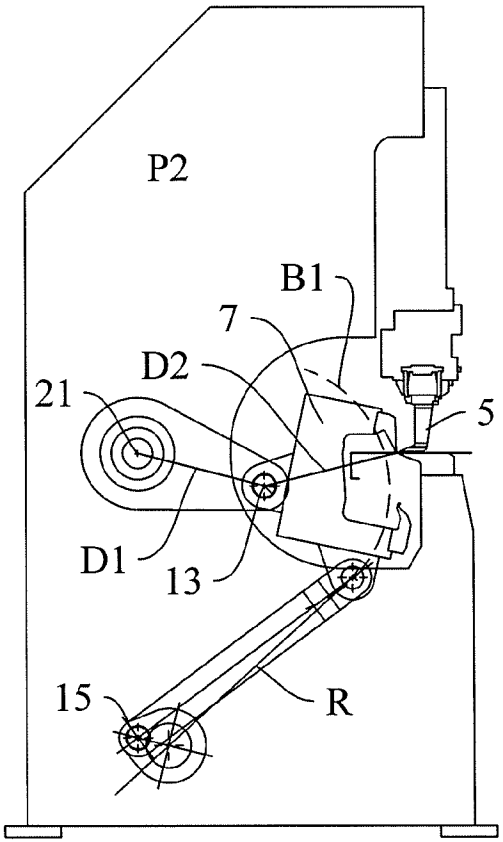
Figure 8:
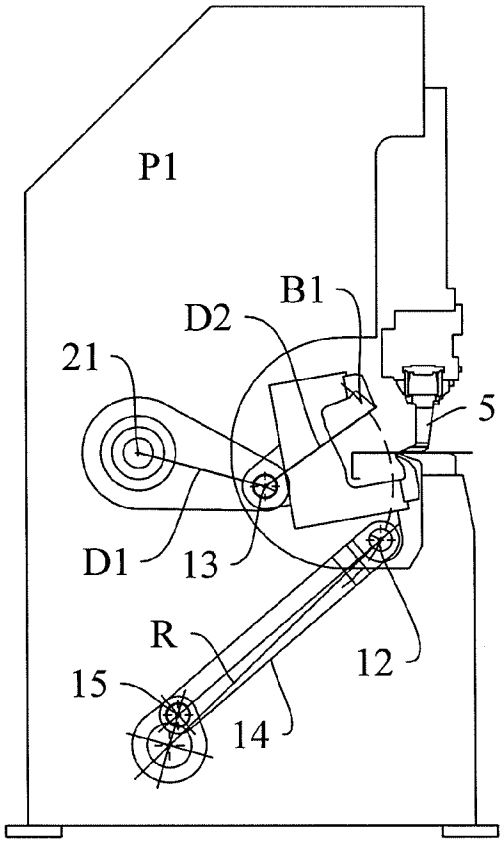

Again by means of the actuating means 100, the paneling machine may actuate working configuration P2 in FIG. 3, in which the blade holder 7 is rotated, again by the actuating means 100, to allow the upper blade 11 to bend the panel sheet 4 downwards. In both working positions P1 and P2, as shown in FIG. 8-9, the cam 15, 16 displaces the pin 12 on an arc of circumference B1 having its center in the rotation axis of the pin 13; the lower 9 and upper blades 11 are arranged in working positions P1 and P2 with the movement of the cam 15, 16 only, in which the pin 15 is moved without ever crossing the points of singularity identified by the theoretical line R passing through the rotation axes of the disc 16 and the pin 12. The oscillation of the blade holder 7 is due to a light rotation caused by the motorized pin 21 of the first embodiment or by the cam 18, 19 of the further member in case of the second embodiment of the invention. The slight rotation is required to implement small rightward/leftward or upward/downward movements with respect to the blade holder. In working position P2, the profile of the outer surface 141 of the blade 11 is substantially perpendicular to the sheet panel 4.

Figure 10:
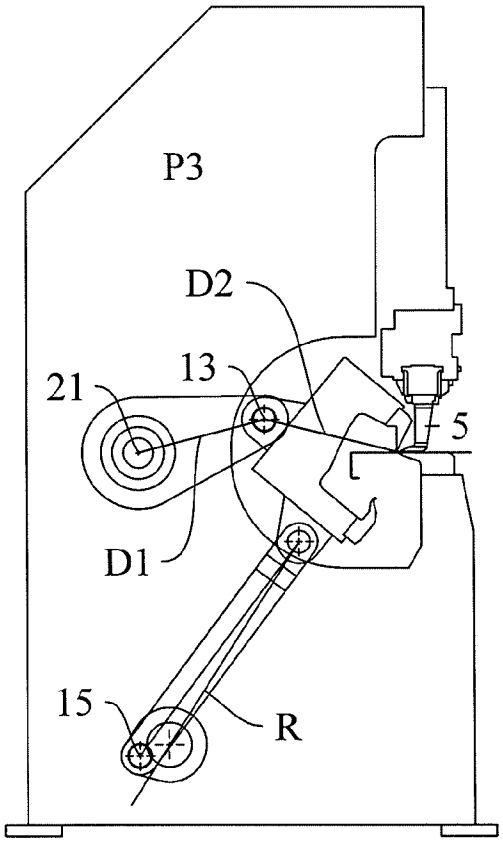
FIGS. 8-10 show the kinematism of the paneling machine in FIG. 1 in working configurations P1-P3.

By means of the actuating means 100 and the particular shape of the blade 11, the paneling machine according to the invention can actuate working configuration P3 in FIG. 4 and FIG. 10, in which the blade holder 7 is rotated and translated vertically to make the bending blade 11 rotate with respect to a rotation axis I, orthogonal to the direction of movement of the blade holder 7, passing through the free end 111 thereof; in particular, the bending blade 11 rotates by an angle substantially equal to the angle Q (preferably comprised between 25° and 35°) of the wedge of the upper blade 11 with respect to working position P2 in FIG. 3. When going from working position P2 to working position P3, the pin 15 of the cam 15, 16 is moved without ever crossing the points of singularity identified by the theoretical line R passing through the rotation axes of the disc 16 and of the pin 12.

The actuating means 100 are adapted to translate the pin 13 vertically, which in FIGS. 2 and 3 is beneath line 40 corresponding to the height of the sheet panel 4 in working position, i.e. beneath the sheet panel 4, while in FIG. 4 it is above line 40, i.e. above the sheet panel 4, in a position symmetric to the previous one. In this manner, the actuating means 100 are adapted to translate and rotate the blade holder 7.

The combination of the roto-translation motion of the blade holder 7 caused by the actuating means 100 and the particular shape of the profile of the inner surface 140 of the blade 11 allows the blade 11 itself to be swiveled with the inner surface profile 140 essentially perpendicular to the plane identified by the panel 4 in working position P3, as shown in FIG. 4. The movement of the blade holder 7 for going from working position P2 to working position P3 is due to the movement of the cam 15, 16 and to the rotation of the motorized pin 21, in the case of the first embodiment of the invention, or the movement of the cam 15, 16 and the movement of the cam 18, 19, in the case of the second embodiment of the invention, in which the pin 21 is idle. Again, the combination of the movement of the cam 15, 16 and of the rotation of the motorized pin 21, in the case of the first embodiment of the invention, or the combination of the movement of the cam 15, 16 and of the movement of the cam 18, 19, in the case of the second embodiment of the invention, allow the upper blade 11 to make small vertical or horizontal movements with respect to the counter-blade 3.

The paneling machine in accordance with the invention allows making bending profiles not achievable with paneling machines of the prior art.

Figure 5:
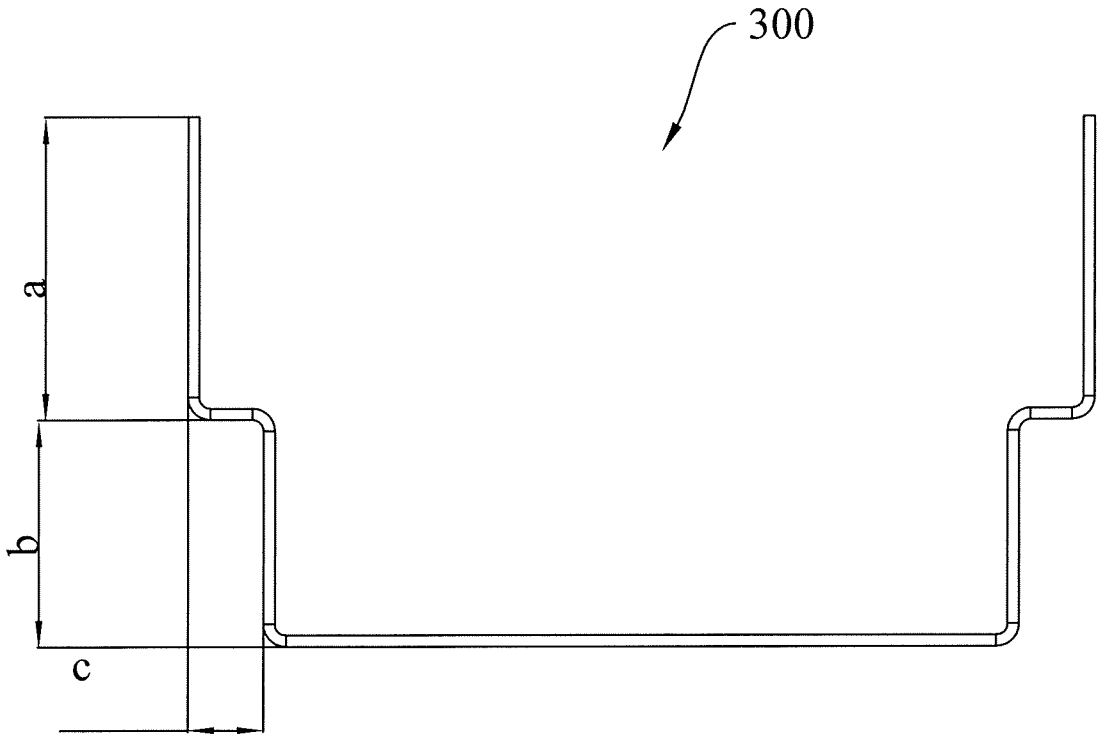
FIG. 5 shows a sheet panel with a given bending profile.

FIG. 5 shows, for example, a particular bending profile 300 for the panel sheet 4 which may be made by the paneling machine in accordance with the invention; the profile comprises a small width counter-bend "c" interposed between two greater width bends "a" and "b".

Figure 6:
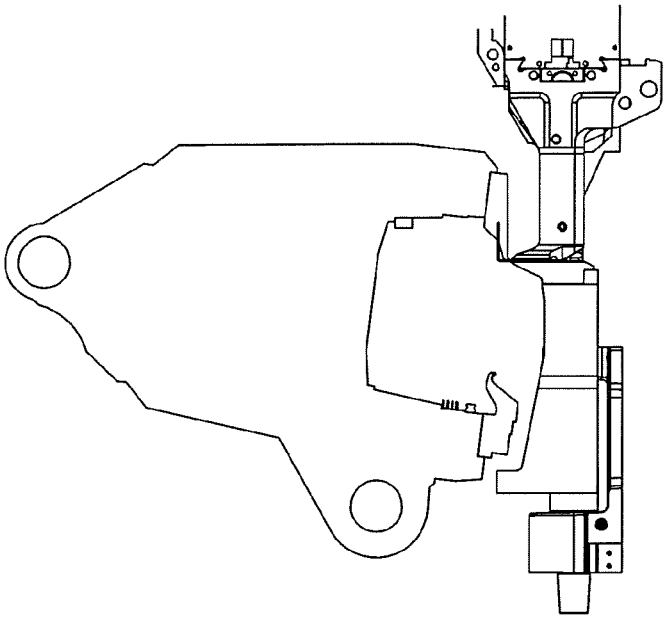
FIG.6 PRIOR ART
FIG. 6 shows a part of a known paneling machine in greater detail.

We will assume to intend to make the profile 300 on the sheet panel 4 and that the paneling machine 1 has already made the upward bend "a". FIG. 6 shows the limits of a paneling machine according to the prior art to make the counter-bend "c" if the blade holder 7 is not translated vertically and rotated. Without the combination of a rotation and a vertical translation of the blade holder 7 it is not possible to perform the sequence of bends according to the profile in FIG. 5 for reasons of mechanical interference between panel 4 and bending blade 11. Furthermore, again in FIG. 6, the limits of a paneling machine of the prior art are shown in making wide bend with a high edge sheet panel (shown with a dashed line) once again if the blade holder 7 is not translated vertically and rotated.

Figure 7:
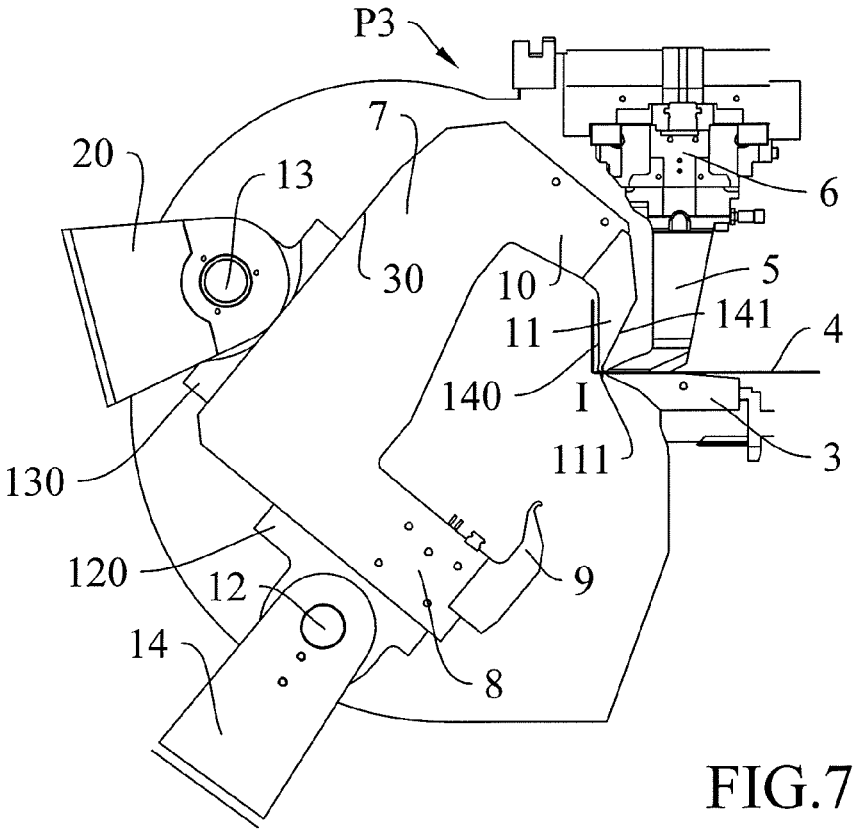
FIG. 7 shows a part of the paneling machine in FIG. 4 in greater detail.

FIG. 7 shows the overcoming of the constraint with the blade holder 7 in working position P3 translated and rotated by a given angle clockwise with respect to working position P2, and thus with a different orientation from that shown.

Figure 12B:
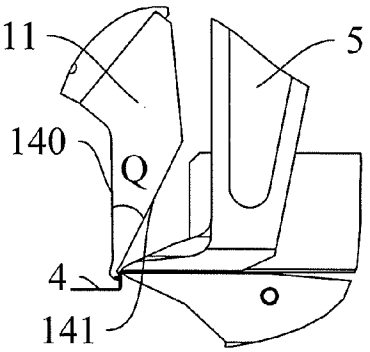
FIGS. 12*a*-12*b* show a bending sequence of a sheet panel with the paneling machine in the third working position.
Figure 12A:
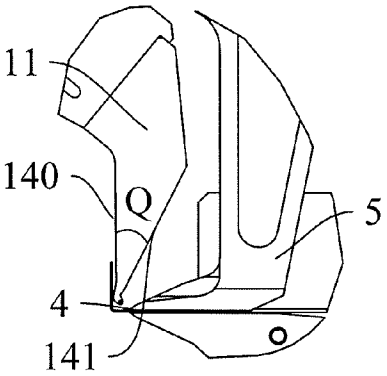
Figure 12C:
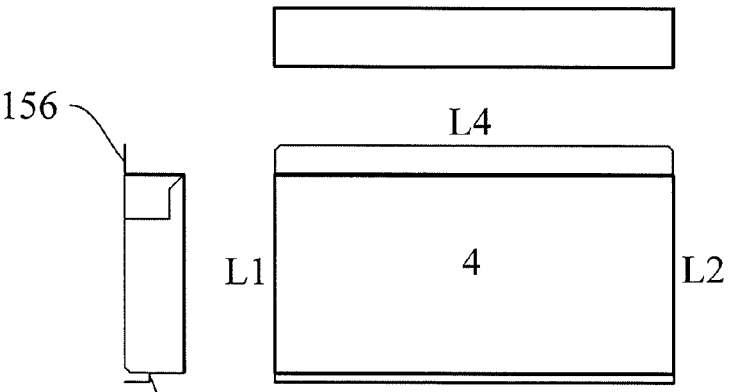
FIG. 12*c* shows a panel which can be made using the bending machine according to the invention.
Figure 11B:
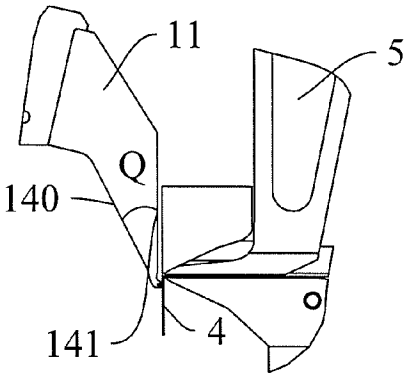
FIG. 11*a*-11*b* show a bending sequence of a sheet panel with the paneling machine in the second working position.
Figure 11A:
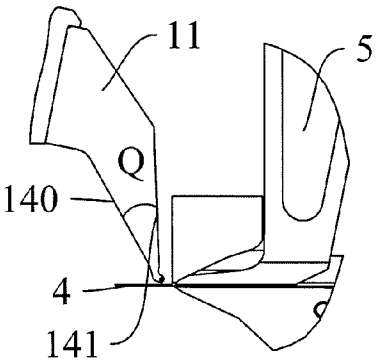
Figure 11C:
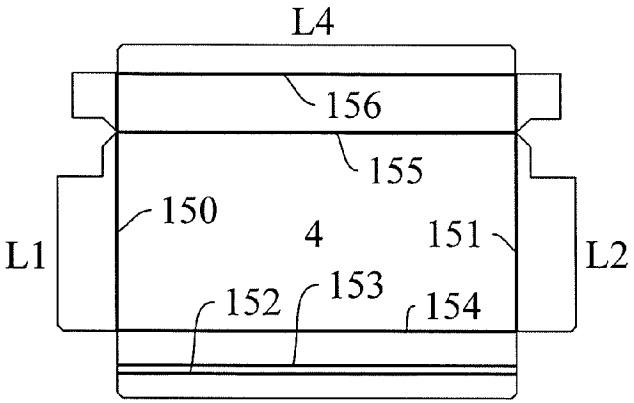
FIG. 11*c* shows the net of the panel in FIG. 12*c;*
Figure 13B:
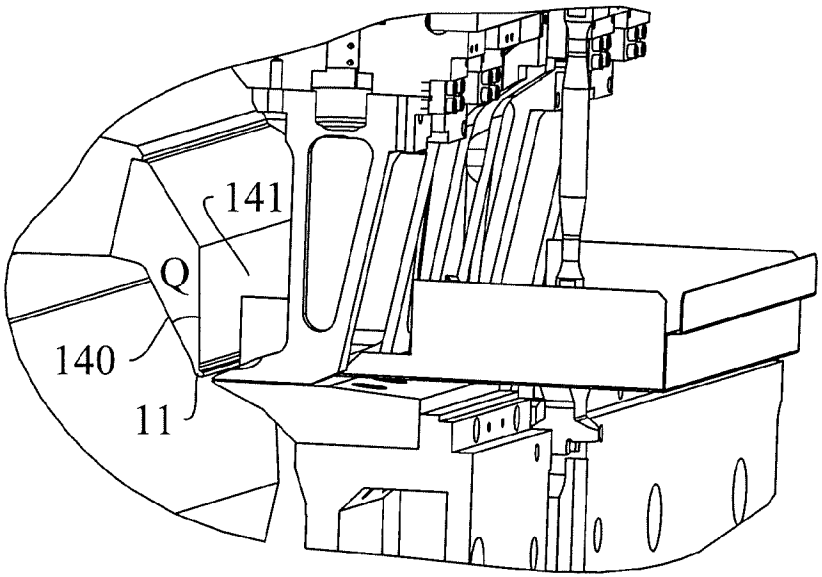
FIGS. 13*a*-13*b* are perspective views of the paneling machine in the third and second working position.

FIG. 12*c* shows three orthogonal views of a panel 4 which can only be made using the paneling machine described in this invention. FIG. 11*c* is a flat development of the panel at hand with sequential numbering 150-155 of the bend sequence. In particular, the downward negative bend 155 on the side L4 of the panel may be made only with the blade holder in working position P2 not to interfere with the bends 150 and 151 already made on sides L1 and L2 adjacent to side L4 processed as shown in FIGS. 11*a*-11*b* and shown in greater detail in the perspective view in FIG. 13*b*. In that case, the blade holder 7, rotated in working position P2, is positioned with the end 111 of the upper blade 11 in contact with the upper surface of the sheet panel 4 so that the profile of the outer surface 141 of the upper blade 11 is essentially perpendicular to the sheet panel 4 in working position. The perpendicularity of the outer surface 141 of the blade 11 avoids collision of the bends 150, 151 already made on sides L1 and L2 of the panel.

Figure 13A:
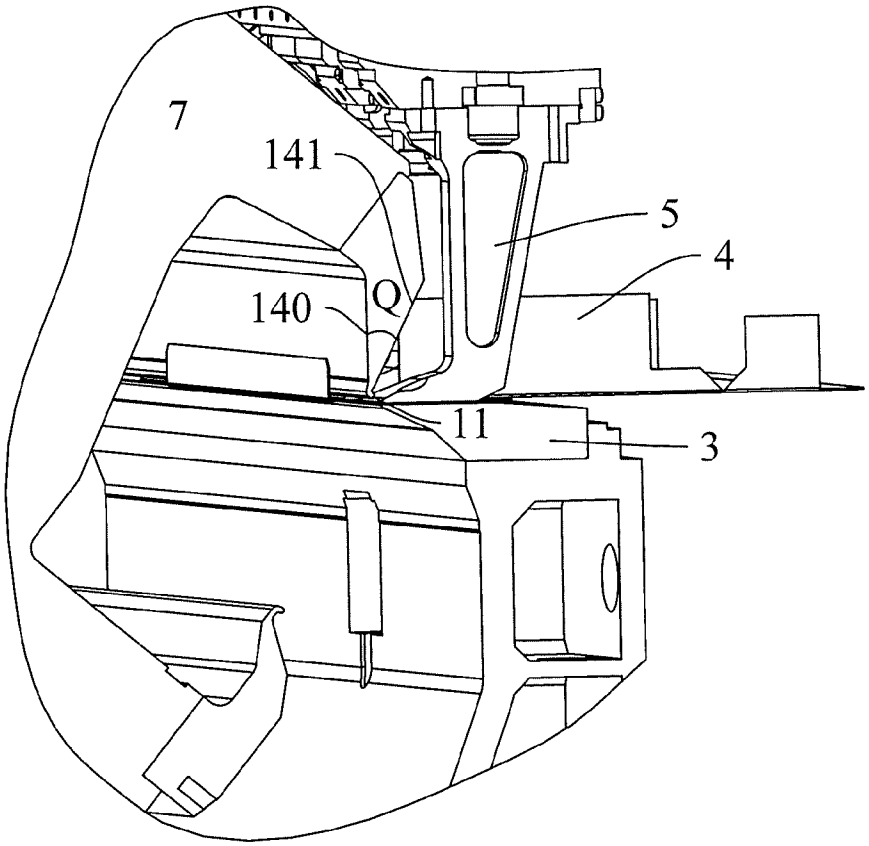

Again with reference to FIG. 11*c*-12*c*, the counter-bend 153 on side L3 can be made with the bending sequence shown in FIG. 12*a*-12*b*. In this case, the blade holder 7 is translated and rotated by the actuating means 100 so that the end 111 of the upper blade 11 is in contact with the upper surface of the sheet panel 4 and the blade 11 itself is rotated with respect to the rotation axis I passing through the free end 111. The blade 11 performs a rotation with respect to the working position P2 of the angle Q of the wedge of the blade 11, preferably comprised between 25° and 35°, so that the blade 11 is positioned by the blade holder 7 so that the profile of the inner surface 140 is substantially perpendicular to the sheet panel 4 in working position; in this manner, it is possible to make the bend 153 by pressing the blade 11 downwards on the panel 4. The perspective view in FIG. 13*a* shows this in greater detail. By considering even the perspective view in FIG. 13*b*, the particular blade 11 with its wedge shape and the surfaces 140, 141 which depart from the end 11 by forming an angle Q preferably comprised between 25° and 35° is better shown. Surfaces 140, 141 are preferably flat.

Thus, the inclination of the blade 11 is such to allow the profile of its inner surface 140 to remain essentially perpendicular to the sheet panel 4 arranged on the horizontal plane.

Figure 14A:
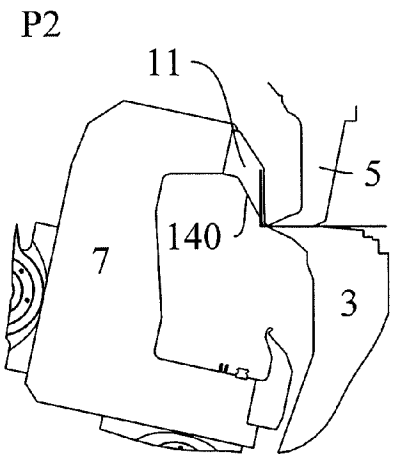
FIGS. 14*a*-14*c* and 15*a*-15*c* show two limit cases of downward bending of the sheet panel which can be obtained only with the blade holder rotated with respect to the usual condition.
Figure 14B:
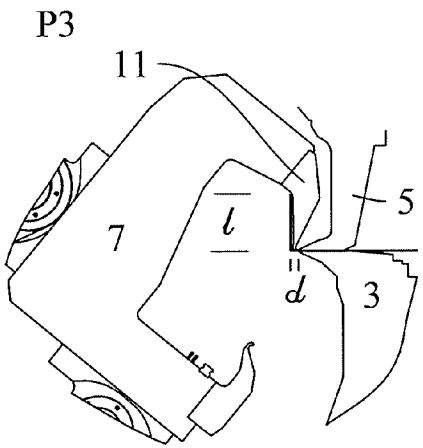
Figure 14C:
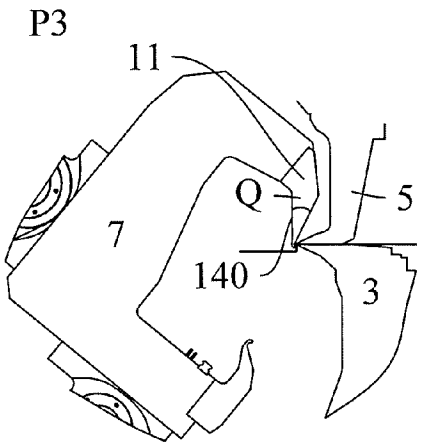
Figure 15A:
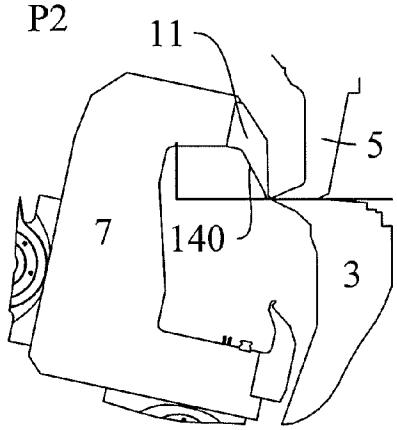
Figure 15B:
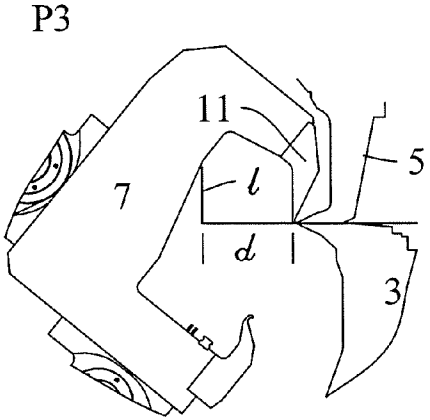
Figure 15C:
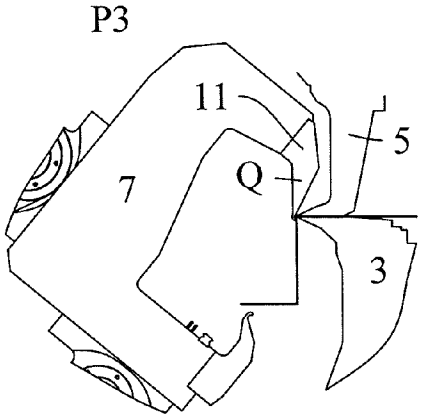

FIGS. 14*b*-14*c* show the bending sequence which allows to make a wide bend "d" on a sheet panel 4 with a high upward edge "1" in working position P3; the blade holder 7 is translated and rotated by the actuating means 100 so that the end 111 of the upper blade 11 is in contact with the upper surface of the sheet panel 4 and the blade 11 itself is rotated with respect to the rotation axis I passing through its free end 111. The blade 11 rotates by the angle Q of the wedge of the blade 11, preferably comprised between 25° and 35° with respect to working position P2, so that the blade 11 is positioned by the blade holder 7 with the profile of the inner surface 140 substantially perpendicular to the sheet panel 4 in working position. It is then possible to make the bend "d" by pressing the blade 11 downwards on the panel 4. FIG. 14*a* clearly shows the interference condition of the panel blade with the blade holder in the usual position P2. FIGS. 15*a*-15*c* show a similar interference situation and how it can be overcome by rotating the blade holder with bend width "d" extended to the maximum possible.

In the operation of the machine 1 in the first and second embodiment alike (FIGS. 1-4), the sheet panel 4 to be machined is clamped between counter-blade 3 and blank holder 5 but arranged so as to protrude towards the inside of the machine 1 near the blades 9 and 11 to allow bending; the blades 9, 11 work on the clamped panel 4 until bending is completed. The blade holder 7 with its rotation movement guides the blades 9, 11 for making upwards and downward bends on the panel 4, respectively. In order to prevent collisions between one of the blades 9, 11 and a previously bent sheet panel 4 with an edge of a given dimension, the actuating means 100 are adapted to translate vertically and rotate the blade holder 7 through the combined movement of the connecting rods 14, 20 so that the blade 11 does not interfere with the high edge of the panel 4.

The actuating means 100 implement a kinematism with three degrees of freedom with only two actuators, i.e. the cam 15, 16 and the motorized pin 12 in the case of the first embodiment of the invention or the cams 15, 16 and 18, 19 in the case of the second embodiment of the invention. The blade holder 7, with the three degrees of freedom, may translate vertically or horizontally with respect to the counter-blade 3.

Having defined D1 and D2 as the distance between pin 21 and pin 13 and the distance between pin 13 and free end 111 of the blade 11, respectively (as shown in greater detail in FIGS. 9-10), when going from the working position P2 in FIG. 3 to the working position P3 in FIG. 4, the motorized connecting rod-cam system 14-16, 17-19 (second embodiment of the invention) or the motorized connecting rod-cam system 14-16 and the motorized pin 12 (first embodiment of the invention) works on the blade holder 7 so that the pin 13 translates vertically upwards, thus maintaining the distances D1 and D2 constant. In this manner, a rotation of the upper blade 11 is obtained which performs a rotation of the angle Q, i.e. an angle comprised between 25° and 35°, on the rotation axis I passing through the free end 111 going from working position P2 to working position P3. The particular shape of the inner surface of the upper blade 11 allows the profile of the inner surface 140 to be essentially orthogonal to the sheet panel 4 with the blade 11 in working position P3.

Thus, the actuating means 100 are structured to allow the rotation of the blade holder 7 along the arc of circumference B1 having its center of gravity in the rotation axis of the pin 13 to go from working position P1 to working position P2 and vice versa. The actuating means 100 are further structured to allow the rotation and translation of the blade holder 7 so as to rotate the blade 11 on the axis I passing through the end 111 of the angle Q to go from the working position P2 to the working position P3.

In the operation of the machine 1 (see FIGS. 2, 3 and 4), in its second embodiment, the further connecting rod-cam system 17-19 supports the already present connecting rod-cam system 14-16 and moves the blade holder 7 by working on the pin 13. The movement impressed on the blade holder 7 by the actuating means of the second embodiment of the invention remains unchanged with respect to the actuating means 100 of the first embodiment of the invention but exploits a less powerful motor.

The combinations of the movements described above and the possibility of rotating and translating the blade holder 7 allow the paneling machine 1 to carry out a wide range of bending profiles.

The invention claimed is:

1. A panel bending machine, comprising:

a counter-blade and a blank holder that are shaped so as to clamp a sheet metal panel to be bent in working positions;

a C-shaped blade holder that supports at least a first bending blade and a second bending blade at respective terminals of said C-shaped blade holder, said second bending blade having an axis that passes through a free end of said second bending blade; and an actuating system of said C-shaped blade holder that is structured and arranged so as to swivel said second bending blade in a first working position of said working positions and in a second working position of said working positions;

wherein said actuating system of said C-shaped blade holder is structured and arranged to operate said C-shaped blade holder such that said second bending blade rotates about the axis that passes through the free end of said second bending blade to move said second bending blade from said first working position to said second working position.

2. The panel bending machine of claim 1, wherein said second bending blade has a wedge-shape, and said actuating system of said C-shaped blade holder is structured and arranged to cause rotation of said second bending blade by an angle that is essentially equal to an angle of the wedge-shape to move said second bending blade from said first working position to said second working position.

3. The panel bending machine of claim 1, wherein:

said actuating system is structured and arranged to rotate and translate said C-shaped blade holder;

said second bending blade has an inner surface with a given shape which faces said C-shaped blade holder such that a combination of rotational and translational movement of said C-shaped blade holder and the given shape of said second bending blade allows said second bending blade to be swiveled such that a profile of the inner surface of said second bending blade is essentially orthogonal to the sheet panel in said second working position.

4. The panel bending machine of claim 1, wherein:

said actuating system is structured and arranged to rotate said C-shaped blade holder;

said second bending blade has an outer surface with a given shape which faces said blank holder such that a combination of rotational movement of said C-shaped blade holder and the given shape of the outer surface of said second bending blade allows said second bending blade to swivel such that a profile of the outer surface of the second bending blade is substantially orthogonal to the sheet metal panel in said first working position.

5. The panel bending machine of claim 1, wherein said actuating system of said C-shaped blade holder is structured and arranged to have three degrees of freedom using only two actuators.

6. The panel bending machine of claim 1, wherein:

said actuating system comprises at least one first member hinged to one of said terminals of said C-shaped blade holder and a second member hinged by a pin to a connection portion of said C-shaped blade holder that connects said terminals; and said actuating system is structured and arranged such that said pin translates vertically from a position beneath the sheet metal panel to a position above the sheet metal panel when said C-shaped blade holder moves from said first working position to said second working position.

7. The panel bending machine of claim 6, wherein said first member comprises a connecting rod having one end connected to a motorized cam and another end rotationally connected to one of said terminals of said C-shaped blade holder.

8. The panel bending machine of claim 7, and further comprising a frame, wherein said motorized cam is arranged on a lower part of said frame beneath said counter-blade, and wherein the one of said terminals is a lower terminal of said C-shaped blade holder having said first bending blade supported there at.

9. The panel bending machine of claim 6, wherein said actuating system is structured and arranged to allow vertical translation of said pin while maintaining a constant distance between said pin and said free end of said second blade.

10. The panel bending machine of claim 6, wherein said pin is a first pin, and said second member comprises a connecting rod having one end connected to a further pin and another end rotationally connected by said first pin to said connection portion of said C-shaped blade holder that connects said terminals.

11. The panel bending machine of claim 10, wherein said further pin is arranged essentially at the height of the sheet metal panel clamped between said counter-blade and said blank holder.

12. The panel bending machine of claim 11, wherein said further pin is motorized.

13. The panel bending machine of claim 10, wherein said further pin is idle and said actuating system comprises a third member comprising a connecting rod having one end hinged to said connection portion and another end connected to a motorized cam.

14. The panel bending machine of claim 13, and further comprising a frame, wherein said motorized cam to which the one end of said connecting rod of said third member is hinged is connected to an upper part of said frame above said counter-blade.

15. The panel bending machine of claim 6, wherein said actuating system is structured and arranged to move said C-shaped blade holder between said first working position and a further working position of said first blade by rotating said C-shaped blade holder about an axis passing through said pin.

16. The panel bending machine of claim 2, wherein:

said actuating system is structured and arranged to rotate and translate said C-shaped blade holder;

said second bending blade has an inner surface with a given shape which faces said C-shaped blade holder such that a combination of rotational and translational movement of said C-shaped blade holder and the given shape of said second bending blade allows said second bending blade to be swiveled such that a profile of the inner surface of said second bending blade is essentially orthogonal to the sheet panel in said second working position.

17. The panel bending machine of claim 2, wherein:

said actuating system is structured and arranged to rotate said C-shaped blade holder;

said second bending blade has an outer surface with a given shape which faces said blank holder such that a combination of rotational movement of said C-shaped blade holder and the given shape of the outer surface of said second bending blade allows said second bending blade to swivel such that a profile of the outer surface of the second bending blade is substantially orthogonal to the sheet metal panel in said first working position.

18. The panel bending machine of claim 3, wherein said second bending blade has an outer surface with a given shape which faces said blank holder such that a combination of rotational movement of said C-shaped blade holder and the given shape of the outer surface of said second bending blade allows said second bending blade to swivel such that a profile of the outer surface of the second bending blade is substantially orthogonal to the sheet metal panel in said first working position.

19. The panel bending machine of claim 16, wherein said second bending blade has an outer surface with a given shape which faces said blank holder such that a combination of rotational movement of said C-shaped blade holder and the given shape of the outer surface of said second bending blade allows said second bending blade to swivel such that a profile of the outer surface of the second bending blade is substantially orthogonal to the sheet metal panel in said first working position.

20. The panel bending machine of claim 2, wherein said actuating system of said C-shaped blade holder is structured and arranged to have three degrees of freedom using only two actuators.

* * * * *